United States Patent [19]

Smith et al.

[11] 4,047,339

[45] Sept. 13, 1977

[54] HIGH LOAD EXTENDIBLE STRUCTURE

[75] Inventors: Gordon A. Smith, Gaithersburg; James M. Talcott, Clarksburg, both of Md.

[73] Assignee: Fairchild Industries, Inc., Germantown, Md.

[21] Appl. No.: 345,837

[22] Filed: Mar. 29, 1973

[51] Int. Cl.[2] ..... E04H 12/16

[52] U.S. Cl. ..... 52/108; 52/734; 242/54 A

[58] Field of Search ..... 52/108, 573, 731, 716, 52/729; 343/878; 242/54 A; 29/423; 30/286; 61/60

[56] References Cited

U.S. PATENT DOCUMENTS

| | | | |
|---|---|---|---|
| 1,888,751 | 11/1932 | Wemlinger | 61/60 |
| 2,071,674 | 2/1937 | Whitlock | 52/716 |
| 2,166,798 | 7/1939 | Côte | 52/729 |
| 2,289,311 | 7/1942 | Wellman | 29/423 |
| 2,315,640 | 4/1943 | Morse | 52/108 |
| 2,352,526 | 6/1944 | Farrand | 52/108 |
| 2,531,967 | 11/1950 | Bishop | 52/716 |
| 2,781,849 | 2/1957 | Bladergroen | 29/423 |
| 3,298,142 | 1/1967 | Isaac | 52/108 |
| 3,357,457 | 12/1967 | Myer | 242/54 A |
| 3,434,254 | 3/1969 | Rubin | 52/573 |
| 3,528,543 | 9/1970 | Robinsky | 52/108 |
| 3,566,661 | 3/1971 | McCafferty | 29/423 |
| 3,732,656 | 5/1973 | Robinsky | 52/108 |
| 3,862,528 | 1/1975 | Meissinger | 52/108 |

FOREIGN PATENT DOCUMENTS

| | | | |
|---|---|---|---|
| 104,305 | 7/1899 | Germany | 343/877 |

*Primary Examiner*—Price C. Faw, Jr.
*Assistant Examiner*—Robert C. Farber
*Attorney, Agent, or Firm*—Michael W. York

[57] ABSTRACT

A high load extendible structure including an elongated thin pre-stressed element which has a cross section whose interior portion is curved to form substantially one-half of the perimeter of a circle and whose two exterior portions are each curved in an opposite direction to each form substantially one-quarter of a circle of the same radius as the central portion when the pre-stressed element is unrestrained from a flattened condition. The element is capable of being rolled flat upon a roller and yet can be extended to support or push various loads and plastic beads are located along the edges of the pre-stressed element to provide protection from these sharp edges. An equation is presented for determining the required thickness of the element once the radii associated with the element and the radius of the roller and other parameters for a given application have been determined. A method of forming the elongated thin pre-stressed element is also presented in which the element is formed between a male die having a half circular portion and a female die which has a rectangular channel. Sheets of rubber are utilized in conjunction with the dies to form the element.

15 Claims, 6 Drawing Figures

HIGH LOAD EXTENDIBLE STRUCTURE

BACKGROUND OF THE INVENTION

Extendible pre-stressed tubular structures such as those disclosed in U.S. Pat. Nos. 3,503,164 and 3,696,568 have been known for some time and their usefulness has been generally recognized. These pre-stressed structures or elements have found considerable use in space since they are capable of being rolled into a compact package and yet can be extended to form comparatively long structures which are light in weight compared to their length and volume. The comparative lack of gravitational forces in space also has contributed to the usefulness and effectiveness of such pre-stressed devices, since they were not exposed to such forces which might cause their distortion or damage. The possibility of damage or distortion due to gravitational forces may account for the comparative lack of usage of pre-stressed structures for non-space applications. Pre-stressed elements also form comparatively frail looking structures and this may also explain why they have found such limited usage.

There are however, a number of non-space applications where pre-stressed elements would offer various advantages. For instance, such structures can be used in place of many cables which are used in connection with various types of machinery. Since a cable can only normally be pulled and not pushed whereas a pre-stressed structure can both be pushed and pulled, a pre-stressed structure has various inherent advantages which a cable does not possess, such as the possibility of better control.

It has now been found that by suitably pre-stressing an element so that it has an appropriate cross-section having partially circular sections with appropriate radii, an appropriate structure can be formed that is useful lifting loads and yet at the same time is capable of being readily rolled into a compact configuration. Pre-stressed elements which have a cross-section that includes at least a portion of the circle are by no means new. An example of such a structure is disclosed in U.S. Pat. No. 3,434,254 which discloses a device that was particularly designed for use in space. The device illustrated in FIG. 1 of U.S. Pat. No. 3,434,254 has a central cross-section portion with a radius R and two exterior portions each having a radius R'. It should also be noted that the center of the circle with the radius R is offset by a distance h and that the centers of the circles for the central radius R and for the two exterior radii R' do not lie on one straight line. Furthermore, two such structures are used in tandem and they face each other and have their edges connected together. While the use of two such devices in tandem might have been satisfactory for space applications only one of such structures would appear to have limited usefulness in view of its limited strength.

It has also been recognized in the past that the edges of such extendible elements can cause damage by cutting or snagging and attempts have been made to avoid or prevent such damage. One such solution to this problem is presented in U.S. Pat. No. 3,696,568 which discloses a pre-stressed element whose exterior edges curl inward so that there are no exposed edges in the curled element. However, in most cases it is highly desirable not to have to design the overall configuration of the extendible element to reduce possible damage by its sharp edges.

Usually such pre-stressed elements are formed by a comparatively complex method such as that disclosed in U.S. Pat. No. 3,465,567 which involves heating the element and it would be desirable to simplify such methods.

The present invention overcomes many of the disadvantages present in the prior art devices and provides an extendible pre-stressed element with a unique cross-section which is strong in comparison to its weight which has provision for protection from its sharp edges. The method of the invention also permits the pre-stressed element with a unique cross-section to be formed easily without heating the element.

BRIEF DESCRIPTION OF THE INVENTION

This invention relates to structures having extendible elongated thin pre-stressed elements and more particularly to structures having extendible elongated thin pre-stressed elements which have a cross-section when extended whose interior portions are curved to form a portion of a circle and methods of forming such elements.

It is an object of the present invention to provide an extendible structure having a thin pre-stressed element which can be collapsed into a compact configuration and yet upon being extended is capable of supporting and moving high loads.

It is also an object of the present invention to provide an extendible structure having a thin pre-stressed element which is capable of readily being rolled in a flattened condition.

It is also an object of the present invention to provide an extendible structure having a thin pre-stressed element which does not have any exposed sharp edges.

It is also an object of the present invention to provide a method of forming pre-stressed elements which does not require any heat treatment of the elements.

It is a further object of the invention to provide a method of forming pre-stressed elements which is capable of being used to easily shape pre-stressed elements.

It is a further object of the present invention to provide a method of forming pre-stressed elements which does not require the use of complex equipment.

The present invention provides a high load extendible apparatus including an elongated thin pre-stressed element which is pre-stressed to have a cross-section whose interior portion is curved to form substantially one-half of the perimeter of a circle with its concave side facing in one direction and whose two exterior portions are each curved to form substantially one quarter of the perimeter of a circle with its concave side facing in a another direction when the elongated thin element is unrestrained from a flattened condition. The invention also provides a method of forming an elongated thin pre-stressed metallic element which includes placing a flexible non-metallic sheet on a substantially flat metallic sheet which is to be formed into the thin pre-stressed element and forming at least a portion of the substantially flat metallic sheet by subjecting both the portion of the substantially flat metallic sheet which is to be formed and the adjacently located portion of the flexible non-metallic sheet to pressure.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
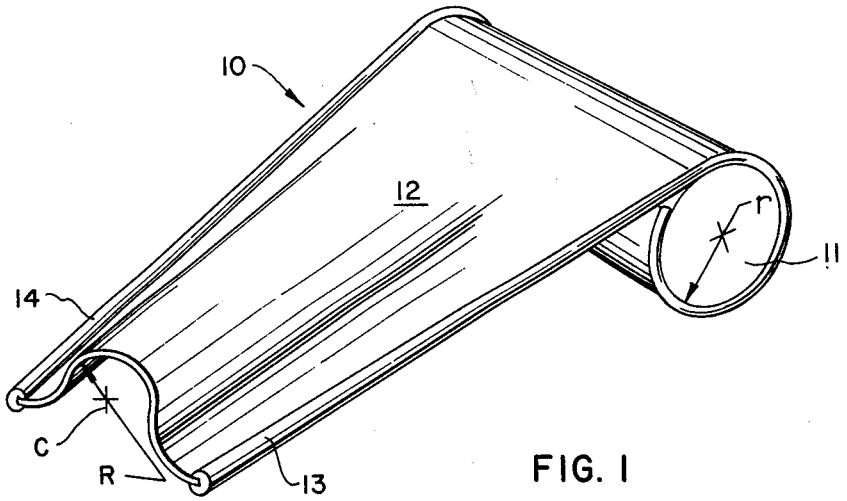
FIG. 1 is a perspective view of the high load extendible structure of the invention with its elongated thin pre-stressed element partially extended.
Figure 2:
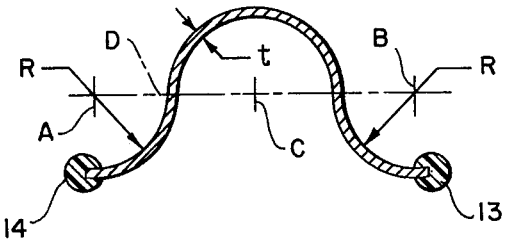
FIG. 2 is a cross sectional view of the extended portion of the elongated pre-stressed element illustrated in FIG. 1.

Referring first to FIGS. 1 and 2, the high load extendible apparatus is illustrated and is designated by the number 10. The extendible apparatus 10 comprises a roller 11 and an elongated thin pre-stressed metallic strip or element 12 which is partially wound in a generally flattened condition on the roller. One longitudinal edge of the metallic element 12 has a plastic bead 13 securely attached to it and the other edge has a similar plastic bead 14 securely attached to it. The plastic beads 13 and 14 prevent the sharp edges of the metallic element 12 from coming into contact with personnel or materials which might be cut or damaged by these sharp edges and at the same time these plastic beads do not interfere with the deployment or the retraction of the metallic element since they readily conform to the curvature of the edges of the metallic element.

As best illustrated in FIG. 2, when the pre-stressed metallic element 12 is unrestrained, it has a cross section whose interior portion is curved to form substantially one-half of the perimeter of a circle with the concave side of the perimeter facing in one direction and whose two outer or exterior portions are each curved to form substantially one quarter of the perimeter of a circle with the concave side of the perimeter facing in another direction. It should also be noted that the radii of the exterior and the interior portions are substantially the same and are designated by the letter R. The centers for the radii for the two exterior quarter circle portions which are designated by the letters A and B and the center for the radius for the interior half circle portion which is designated by the letter C all lie in substantially a common plane designated by the letter D. In addition, the cross section has a continuous curve from the center portion to the exterior portion and there are no flat portions which might tend to interfere with the deployment or storage of the elongated pre-stressed metallic strip 12. For reasons which have not been completely understood, this cross section of the unrestrained element 12 appears to give the element improved column strength while permitting it to be readily wound in its stored condition on the roller 11.

For a given application for the high load extendible apparatus, space, desired operating life and other considerations will in general govern the selection of the following parameters which are set forth and defined below:

R Radii of the cross-section of the element 12

$r$ Radius of the roller 11

S Applied alternating stress, which is found from a well known S-N diagram in which the mean stress equals the alternating stress amplitude and where S is the alternating stress corresponding to the desired number of operating cycles N for the element 12. In addition, the following conventional symbols are well known to anyone skilled in the art:

E Young's Modulus of elasticity for the material selected for the element 12

$\mu$ Poisson ratio It has been discovered that the following equation will give the required minimum thickness t for the element 12 when appropriate values are inserted for the various symbols which have been heretofor described:

$$t = \frac{4S(1-\mu^2)}{E\left[\left(\frac{\mu}{R}+\frac{1}{r}\right)^2+\left(\frac{1}{R}+\frac{\mu}{r}\right)^2-\left(\frac{\mu}{R}+\frac{1}{r}\right)\left(\frac{1}{R}+\frac{\mu}{r}\right)\right]^{\frac{1}{2}}}$$

Once the thickness t has been determined by the use of the above equation or through experimentation for a given material, the material for the element 12 is cut into a long thin substantially flat metallic strip having a width which is determined by the desired radii R and having a length which is dictated by the extention requirements for that particular application. Then a piece of rubber having a thickness of at least ¼ of an inch is cut into a sheet having substantially the same width and length as the cut sheet or strip for the element 12.

Figure 3:
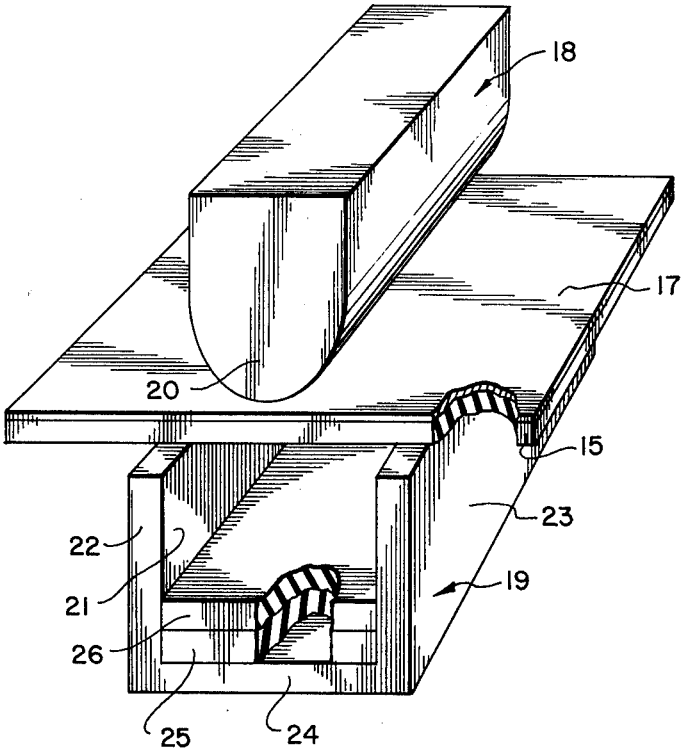
FIG. 3 is a perspective view of the apparatus used to form a pre-stressed element by the method of the invention.

The material for the element 12 is then processed using this sheet of rubber in the manner illustrated in FIGS. 3 through 6. As illustrated in FIG. 3, the cut sheet of rubber which is designated by the number 15 is placed against the lower surface of the substantially flat cut metallic sheet which is designated by the number 17 and which will be used to form the pre-stressed element 12. The combined metallic sheet 17 and rubber sheet 15 with the rubber sheet underneath are then placed between a male die 18 and a female die 19. The male die 18 comprises an elongated bar whose lower portion 20 is shaped to have a cross-section which includes substantially one-half of a circle. The female die 19 comprises an elongated member which has an upward facing channel 21 and a generally U-shaped cross section. The die 19 has sides 22 and 23 which extend upward from a flat base 24 and located in the bottom of the channel 21 is a flat rubber sheet 25 and another flat rubber sheet 26 which lies on top of the sheet 25. Both of these rubber sheets are cut to fill the bottom portion of the channel 21.

Figure 4:
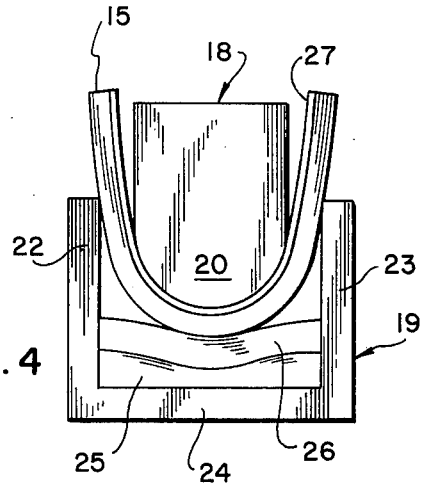
FIG. 4 is an end view of the structure illustrated in FIG. 3 while it is being used to form the longitudinal central portion of a thin metallic sheet.

After the rubber sheet 15 and the sheet 17 are located with their long central portions under substantially the center of the lower portion 20 of the die 18 and with their long central portions located substantially above the center of the channel 21 as illustrated in FIG. 3, the die 18 is pressed into the die 19 as illustrated in FIG. 4, so that pressure is exerted on the portion of the sheet 17 which is to be formed and the adjacently located portion of the non-metallic rubber sheet 15. As illustrated in FIG. 4, the previously unformed sheet which was designated by the number 17 has been formed into a pre-stressed sheet designated by the number 27 which has a generally U-shaped configuration whose center or inner portion is shaped to form substantially one-half of a circle.

Figure 5:
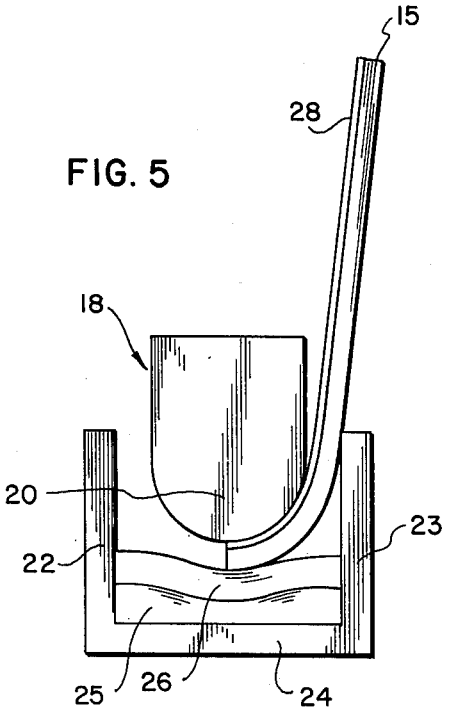
FIG. 5 is an end view of the structure illustrated in FIG. 3 while it is being utilized to form one longitudinal edge portion of the thin metallic sheet after it was formed in the manner illustrated in FIG. 4.

The pre-stressed sheet 27 is then turned over or reversed, held in a flattened condition and the rubber sheet 15 is placed adjacent to its opposite side or what was its upper surface. One edge of the shaft 27 and one edge of the rubber sheet 15 are placed substantially one-half of the way across the width of the channel 21 while the dies 18 and 19 are separated and then the dies are brought together to exert pressure on the portion of the sheet 27 which is to be formed and the adjacently located non-metallic sheet 15 to form the sheet 28 as illustrated in FIG. 5 which has its edge portion shaped into substantially one quarter of a circle in addition to having already had its inner center portion shaped into substantially one-half of a circle.

Figure 6:
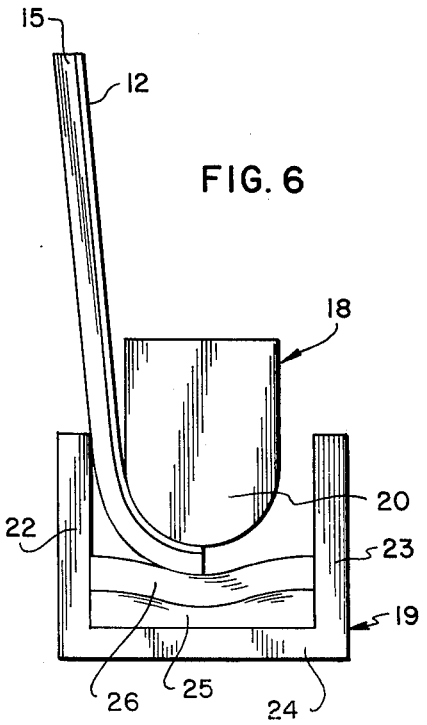
FIG. 6 is an end view of the structure illustrated in FIG. 3 while it is being utilized to form the other longitudinal edge portion of the thin metallic sheet after it was formed in the manner illustrated in FIG. 5.

Then the unformed edge of the sheet 28 and the edge of the rubber sheet 15 are placed substantially one-half of the way across the width of the channel 21 with sheet 28 being held in a generally flattened condition while the dies 18 and 19 are separated. The dies 18 and 19 are then brought together as illustrated in FIG. 6 to exert pressure on the portion of the metallic sheet which is to be formed and the adjacently located portion of the non-metallic sheet to form the completed element 12 which has its other edge portion shaped into substantially one quarter of a circle. The entire pre-stressed sheet or element 12 then has the unrestrined configuration illustrated in FIG. 2. The plastic beads 13 and 14 may then be securely affixed to the respective edges of the element 12 through the use of a suitable bonding agent which is known in the art.

For reasons which are not completely understood, the use of the rubber sheet 15 which is placed against the metallic sheet which is to be formed and the use of the rubber sheets 25 and 26 permit the metallic sheet to be readily formed into a pre-stressed element whose cross-section has a continuous smooth curve.

In the event it is desired to form comparatively long pre-stressed elements, successive portions of the element can be formed using the previously described method until the entire desired length of the element is formed.

Although the invention has been described with reference to a certain preferred embodiment, it will be understood that variations and modifications may be made within the spirit and scope of the invention as defined in the appended claims.

What is claimed is:

1. A method of forming an elongated thin pre-stressed metallic element comprising placing a flexible non-metallic sheet on a substantially flat metallic sheet which is to be formed into the thin pre-stressed element, and forming at least a portion of the substantially flat metallic sheet by subjecting both the portion of the substantially flat metallic sheet which is to be formed and the adjacently located portion of the flexible non-metallic sheet which is located on the substantially flat metallic sheet to pressure.

2. The method of forming an elongated thin pre-stressed metallic element of claim 1 wherein the portion of the flat metallic sheet which is subjected to pressure comprises a central portion of said sheet.

3. The method of forming an elongated thin pre-stressed metallic element of claim 1 further comprising the step of affixing a nonmetallic bead to an edge of said flat metallic sheet after said flat metallic sheet has been subjected to pressure.

4. The method of forming an elongted thin pre-stressed metallic element of claim 1 further comprising the steps of reversing said metallic sheet, placing said non-metallic sheet against the opposite side thereof and forming an additional portion of said metallic sheet by subjecting both the portion of the metallic sheet which is to be formed and the adjacently located portions of said non-metallic sheet which is located on the metallic sheet to pressure.

5. The method of forming an elongated thin pre-stressed metallic element of claim 4 wherein the portion of said metallic sheet which is subjected to pressure after reversing said metallic sheet comprises an edge portion of said sheet.

6. The method of forming an elongated thin pre-stressed metallic element of claim 4 further comprising the initial step of selecting the minimum thickness of the material for the element which is to be formed from substantially the equation, $$t = \frac{4S(1-\mu^2)}{E\left[\left(\frac{\mu}{R}+\frac{1}{r}\right)^2+\left(\frac{1}{R}+\frac{\mu}{r}\right)^2-\left(\frac{\mu}{R}+\frac{1}{r}\right)\left(\frac{1}{R}+\frac{\mu}{r}\right)\right]^{\frac{1}{2}}}$$

where $t$ is the thickness of the element, $r$ is the radius of a roller upon which the element is to be rolled, S is the applied alternating stress for the desired number of operating cycles for the element, E is Young's modulus, $\mu$ is Poisson's ratio and R is the radii of partial circular cross sections to be formed in the flat metallic sheet and wherein the forming steps include forming partial circular cross sections of radii R in said sheet.

7. The method of forming an elongated thin pre-stressed metallic element of claim 1 wherein said forming stop includes providing a generally U-shaped cross sectional elongated female die member which has a channel and an elongated male die member, placing a flexible non-metallic sheet in the channel of said elongated female die member and exerting pressure on said metallic sheet through the use of said male die member and the female die member with the flexible non-metallic sheet located in its channel.

8. The method of forming an elongated thin pre-stressed metallic element of claim 1 wherein said flexible non-metallic sheet has a thickness of at least ¼ of an inch.

9. The method of forming an elongated thin pre-stressed metallic element of claim 4 including the step of holding said formed metallic sheet in a generally flattened condition prior to forming an additional portion of said metallic sheet.

10. A high load extendible apparatus comprising an elongated thin pre-stressed element, said elongated thin element being pre-stressed to have a cross-section whose interior portion is curved to form one-half of the perimeter of a circle with the concave side thereof facing in one direction and whose two exterior portions are each curved to form one quarter of the perimeter of a circle with the concave side thereof facing in another direction and being pre-stressed to have the centers for the radii of all of said circles lie in a common plane when said elongated thin element is unrestrained from a flattened condition.

11. The high load extendible apparatus of claim 10 wherein the radius of the half a circle formed by the interior portion of the cross-section and the radii of the quarter circles of the two exterior portions are equal.

12. The high load extendible apparatus of claim 11 wherein said cross-section exhibits a continuous curvature.

13. The high load extendible apparatus of claim 11 further comprising a roller upon which said elongated thin pre-stressed element can be at least partially wound.

14. The high load extendible apparatus of claim 10 further comprising a non-metallic bead attached to at least a portion of at least one edge of said elongated thin pre-stressed element, said non-metallic bead being conformable to the curvature of the edge of said elongated thin pre-stressed element.

15. A high load extendible apparatus comrising a roller, an elongated thin pre-stressed element, said elongated thin element being pre-stressed to have a cross-section whose interior portion is curved to form one-half of the perimeter of a circle with the concave side thereof facing in one direction and whose two exterior portions are each curved to form one quarter of the perimeter of a circle with the concave side thereof facing in another direction and being pre-stressed to have the centers for the radii of all of said circles lie in a common plane when said elongated thin element is unrestrained from a flattened condition, the minimum thickness of said element being determined substantially in accordance with the equation, $$t = \frac{4S(1-\mu^2)}{E\left[\left(\frac{\mu}{R}+\frac{1}{r}\right)^2+\left(\frac{1}{R}+\frac{\mu}{r}\right)^2-\left(\frac{\mu}{R}+\frac{1}{r}\right)\left(\frac{1}{R}+\frac{\mu}{r}\right)\right]^{\frac{1}{2}}}$$

where $t$ is the thickness of the element, $r$ is the radius of the roller, S is the applied alternating stress for the desired number of operating cycles for the element, E is Young's modulus, $\mu$ is Poisson's ratio and R is the radii of the half and quarter circles.

* * * * *